US006779342B2

(12) United States Patent
Tanaka

(10) Patent No.: US 6,779,342 B2
(45) Date of Patent: Aug. 24, 2004

(54) STIRLING ENGINE

(75) Inventor: Shozo Tanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/433,066

(22) PCT Filed: Nov. 29, 2001

(86) PCT No.: PCT/JP01/10452

§ 371 (c)(1),
(2), (4) Date: May 30, 2003

(87) PCT Pub. No.: WO02/44630

PCT Pub. Date: Jun. 6, 2002

(65) Prior Publication Data

US 2004/0088973 A1 May 13, 2004

(30) Foreign Application Priority Data

Nov. 30, 2000 (JP) ..... 2000-364952

(51) Int. Cl.[7] ..... F01B 29/10
(52) U.S. Cl. ..... 60/526; 60/517
(58) Field of Search ..... 60/517, 526

(56) References Cited

U.S. PATENT DOCUMENTS 5,146,750 A * 9/1992 Moscrip ..... 60/517
5,329,768 A * 7/1994 Moscrip ..... 60/518
6,578,359 B2 * 6/2003 Ban et al. ..... 60/523

FOREIGN PATENT DOCUMENTS

| | | | |
|---|---|---|---|
| EP | 339298 | A1 | 11/1989 |
| JP | 62-118048 | A | 5/1987 |
| JP | 1-305271 | A | 12/1989 |
| JP | 07-004762 | | 1/1995 |
| JP | 10-205901 | A | 8/1998 |
| JP | 2000-220897 | A | 8/2000 |

* cited by examiner

*Primary Examiner*—Hoang M. Nguyen
(74) *Attorney, Agent, or Firm*—Birch, Stewart, Kolasch & Birch, LLP

(57) ABSTRACT

In a Stirling cycle engine, a regenerator has a bobbin, a resin film wound around the outer surface of the bobbin, and a sheath fitted around the outer surface of the resin film and having a slit formed vertically therein. The resin film has one end fixed on the outer surface of the bobbin, and has the other end led out through the slit and fixed to an end surface of the slit or to the outer surface of the sheath. The sheath is press-fitted on the inner surface of the enclosure. Working gas flows between different layers of the resin film. This reduces the loss of heat due to gas leakage and thereby improves the heat exchange efficiency in the regenerator.

11 Claims, 4 Drawing Sheets

STIRLING ENGINE

This application is the national phase under 35 U.S.C. § 371 of PCT International Application No. PCT/JP01/110452 which has an International filing date of Nov. 29, 2001, which designated the United States of America.

TECHNICAL FIELD

The present invention relates to a Stirling cycle engine provided with a regenerator that offers improved heat exchange efficiency.

BACKGROUND ART

A conventional Stirling cycle engine is provided with, for example, a regenerator as shown in FIG. 6, which is composed of a cylindrical bobbin 3 around the outer surface of which is wound a resin film 2 having very fine irregularities 11 formed on the surface thereof so that gaps are left between different layers of the resin film 2. These gaps result from the resin film 2 having the fine irregularities 11 between different layers thereof. FIG. 7 is a side sectional view of an example of a free-piston-type Stirling cycle refrigerator provided with such a regenerator 1. First, the structure and operation of this free-piston-type Stirling cycle refrigerator 14 will be described.

As shown in FIG. 7, the free-piston-type Stirling cycle refrigerator 14 is provided with an enclosure 6 having working gas such as helium sealed therein, a displacer 17 and a piston 18 that divide the space inside the enclosure 6 into an expansion space 20 and a compression space 19, a linear motor 21 for driving the piston 18 to reciprocate, a heat absorber 12 provided by the side of the expansion space 20 so as to absorb heat from outside, and a heat rejector 13 provided by the side of the compressed space 19 so as to reject heat to outside.

In FIG. 7, reference numerals 22 and 23 represent flat springs that support the displacer 17 and the piston 18, respectively, to permit them to reciprocate under their resilience. Reference numeral 15 represents a heat-rejecting heat exchanger, and reference numeral 16 represents a heat-absorbing heat rejector. These serve to prompt the exchange of heat between the inside and outside of the free-piston-type Stirling cycle refrigerator 14. Between the heat-rejecting heat exchanger 15 and the heat-absorbing heat rejector 16 is provided the regenerator.

In this structure, when the linear motor 21 is driven, the piston 18 moved upward inside the enclosure 6, and compresses the working gas in the compression space 19. Here, the working gas becomes warmer as it is compressed, but simultaneously it is cooled by exchanging heat with the outside air through the heat-rejecting heat exchanger 15. Thus, the process that takes place here is isothermal compression.

Then, the displacer 17, which is so controlled as to reciprocate with a predetermined phase difference kept relative to the piston 18, starts moving downward, and thus the working gas in the compression space 19 is passed through the regenerator 1 to the expansion space 20. Meanwhile, the heat of the working gas is accumulated in the resin film 2 forming the regenerator 1, and thus the working gas becomes cooler.

Next, the piston 18 moves downward, and expands the working gas in the expansion space 20. Here, the working gas becomes cooler, but simultaneously it is heated by absorbing heat from the outside air through the heat absorber 12. Thus, the process that takes place here is isothermal expansion.

Then, the displacer 17 starts moving upward, and thus the working gas in the expansion space 20 is passed through the regenerator I back to the compression space 19. Meanwhile, the working gas receives the heat accumulated in the regenerator 1, and thus becomes warmer. This sequence of events, which together constitute the reversed Stirling cycle, is repeated by the reciprocating movement of the driver, and as a result the heat absorber 12 continues absorbing heat from the outside air and thereby gradually makes it cooler and cooler.

As described above, in the Stirling cycle refrigerator that permits cold to be extracted at the heat rejector 12 by making the working gas reciprocate between the compression space 19 and the expansion space 20 through the regenerator 1, the regenerator 1 accumulates the heat of the compressed, warm working gas and then returns the accumulated heat to the expanded, cool working gas in such a way as to collect cold. Therefore, the larger the amount of heat accumulated in the regenerator, the more efficiently heat can be used, and thus the higher the performance of the Stirling cycle refrigerator can be made.

However, with the regenerator 1 structured as described above, when the resin film 2 wound around the outer surface of the cylindrical bobbin 3 is fitted into the free-piston-type Stirling cycle refrigerator 14, the outer surface of the resin film 2 is not fixed on the inner surface of the enclosure 6. Thus, the working gas tends to leak between the outer surface of the resin film 2 and the inner surface of the enclosure 6. The working gas that so leaks flows between the compression space and the expansion space without contributing to the heat exchange taking place in the regenerator 1. This causes a large loss of heat, and thus lowers the performance of the Stirling cycle engine.

SUMMARY OF THE INVENTION

An object of the present invention is to provide a Stirling cycle engine that operates with a reduced loss of heat due to gas leakage by the use of a regenerator so structured as to easy and inexpensive to manufacture and thus with increased heat exchange efficiency in the regenerator.

To achieve the above object, according to the present invention, in a Stirling cycle engine provided with a regenerator arranged between a compression space and an expansion space so as to serve as a flow passage for working gas reciprocated between the compression and expansion spaces and operate by collecting heat from or releasing heat to the working gas, the regenerator is provided with a bobbin, a resin film wound around the outer surface of the bobbin so as to be kept in intimate contact therewith, and a sheath fitted around the outer surface of the resin film and having a slit formed in a longitudinal direction. Here, one end of the resin film is firmly fitted to the outer surface of the bobbin, the outer surface of the resin film is kept in intimate contact with the sheath, and the working gas flows between different layers of the resin film.

In this structure, no gap is left between the resin film and the sheath nor between the resin film and the bobbin, and thus the working gas does not leak. This helps improve the heat exchange efficiency in the regenerator.

Alternatively, according to the present invention, in a Stirling cycle engine provided with a regenerator arranged between a compression space and an expansion space so as to serve as a flow passage for working gas reciprocated between the compression and expansion spaces and operate by collecting heat from or releasing heat to the working gas, the regenerator is provided with a bobbin, a resin film wound around the outer surface of the bobbin, and a sheath fitted around the outer surface of the resin film and having a slit formed vertically therein. Here, the resin film has one end fixed on the outer surface of the bobbin, and has the other end led out through the slit and fixed to an end surface of the slit or to the outer surface of the sheath. Moreover, the working gas flows between different layers of the resin film.

In this structure, it is possible to minimize the gaps between the resin film and the sheath and between the resin film and the bobbin. This helps improve the heat exchange efficiency in the regenerator.

Alternatively, according to the present invention, in a Stirling cycle engine provided with a regenerator arranged inside an enclosure provided between a compression space and an expansion space so as to serve as a flow passage for working gas reciprocated between the compression and expansion spaces and operate by collecting heat from or releasing heat to the working gas, the regenerator is provided with a bobbin, a resin film wound around the outer surface of the bobbin, and a sheath fitted around the outer surface of the resin film and having a slit formed vertically therein. Here, the resin film has one end fixed on the outer surface of the bobbin, and has the other end led out through the slit and fixed to an end surface of the slit or to the outer surface of the sheath. Moreover, the sheath is press-fitted on the inner surface of the enclosure, and the working gas flows between different layers of the resin film.

In this structure, it is possible to minimize the gaps between the regenerator and the enclosure and thereby prevent the leakage of the working gas out of the regenerator.

In the Stirling cycle engine described above, O rings may be fitted on the outer surface of the regenerator so that no gap is left between the regenerator and the enclosure. This helps prevent the leakage of the working gas between the regenerator and the enclosure. Moreover, a layer of air is formed between the regenerator and the enclosure. This layer of air shields the heat of the working gas so that it does not dissipate by conducting through the sheath to the enclosure, and thus helps improve the heat exchange efficiency in the regenerator.

In the Stirling cycle engine described above, the space between the regenerator and the enclosure may be filled with adhesive so that no gap is left between the sheath and the enclosure. This helps prevent the leakage of the working gas between the regenerator and the enclosure. Moreover, a layer of resin of the adhesive is formed between the regenerator and the enclosure. This layer of resin shields the heat of the working gas so that it does not dissipate by conducting through the sheath to the enclosure, and thus helps improve the heat exchange efficiency in the regenerator.

In the Stirling cycle engines described above, the sheath may have protruding claw portions formed at one end or both ends thereof, with the claw portions folded back onto the resin film so that the resin film is fixed so as not to move vertically. This helps reduce ineffective work by the flow of the working gas and thereby improve the heat exchange efficiency.

In the Stirling cycle engines described above, the sheath may be formed of a highly heat insulating material. This shields the heat of the working gas flowing through the regenerator so that it does not conduct to the enclosure, and thus helps realize a Stirling cycle engine that operates with improved heat exchange efficiency in its regenerator.

In these Stirling cycle engines according to the present invention, the regenerator has a simple structure with a resin film wound between a bobbin and a sheath. This helps realize a Stirling cycle engine that is easy and inexpensive to manufacture.

DETAILED DESCRIPTION

Figure 7:
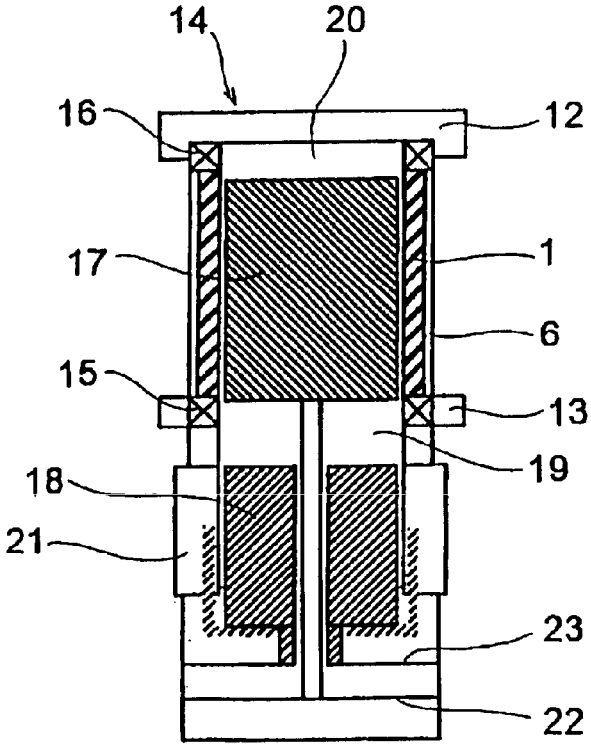
FIG. 7 is a side sectional view of a conventional free-piston-type Stirling cycle refrigerator.

In the embodiments described hereinafter, the overall structure is substantially the same as that of the conventional free-piston-type Stirling cycle refrigerator 14 shown in FIG. 7, with only the structure of the regenerator 1 varying from one embodiment to another. Therefore, in the following descriptions, such members as are referred to with the same names are identified with the same reference numerals, and overlapping explanations will not be repeated. It is to be noted that, in the present specification, a bobbin denotes a substantially cylindrical hollow or solid core around which a resin film is wound.

First Embodiment

Figure 1:
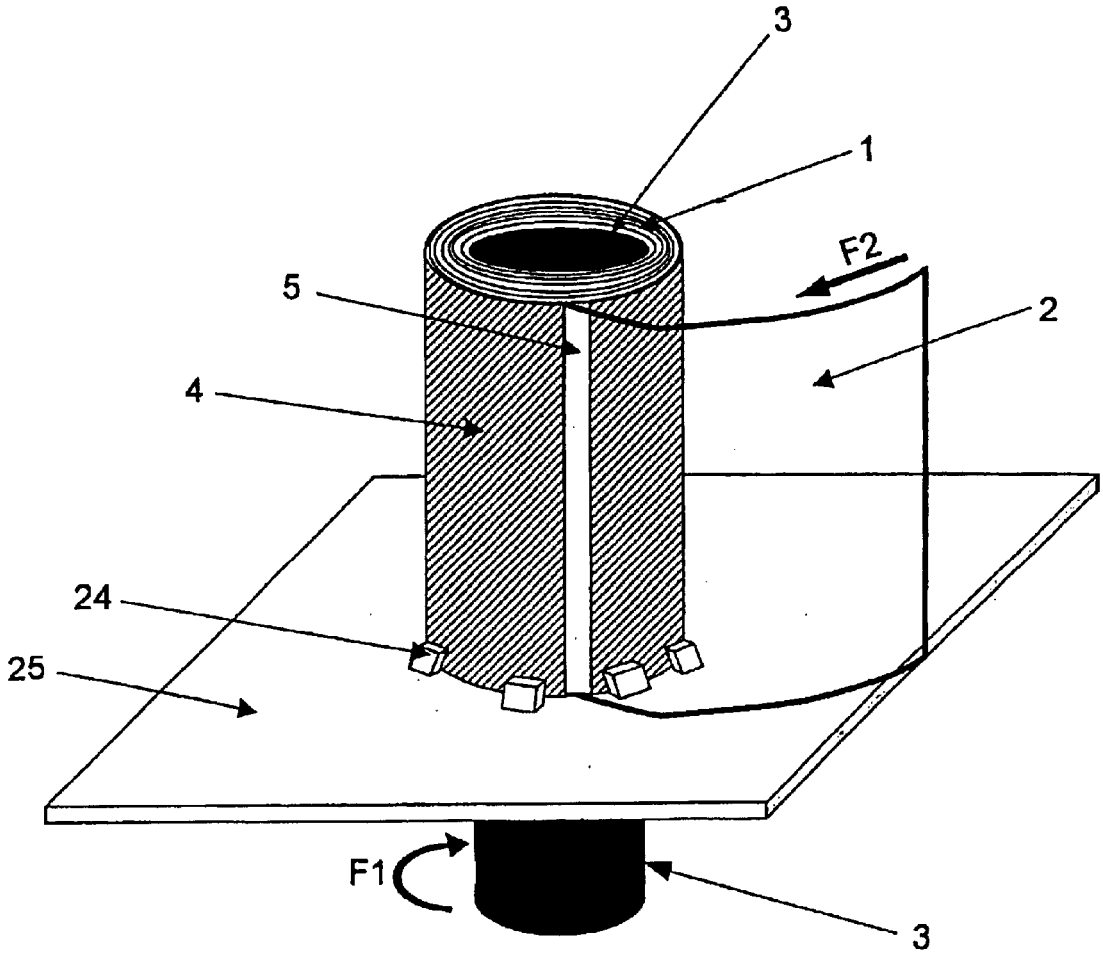
FIG. 1 is a perspective view showing the manufacturing process of the regenerator used in a first embodiment of the invention.

FIG. 1 is a perspective view showing the manufacturing process of the regenerator 1 used in a first embodiment of the invention. A cylindrical bobbin 3 is put through a support stand 25, and around the cylindrical bobbin 3 is fitted a thin-walled cylindrical sheath 4 having a larger diameter than the cylindrical bobbin 3. The thin-walled cylindrical sheath 4 is fixed to the support stand 25 with stoppers 24. The thin-walled cylindrical sheath 4 has a slit 5 formed vertically therein.

Next, one end of a resin film 2 is inserted through the slit 5 and is fixed to the outer surface of the cylindrical bobbin 3, and then the cylindrical bobbin 3 is rotated in the direction indicated by arrow F1 so that the resin film is farther inserted through the slit 5 as indicated by arrow F2 and is wound around the outer surface of the cylindrical bobbin 3. When the resin film 2 so would reaches the inner surface of the thin-walled cylindrical sheath 4, the rotation of the cylindrical bobbin 3 is stopped. Then, the resin film 2 is cut, and this end of the resin film 2 is fixed to an end surface of the slit 5 or to the outer surface of the thin-walled cylindrical sheath 4.

Figure 2:
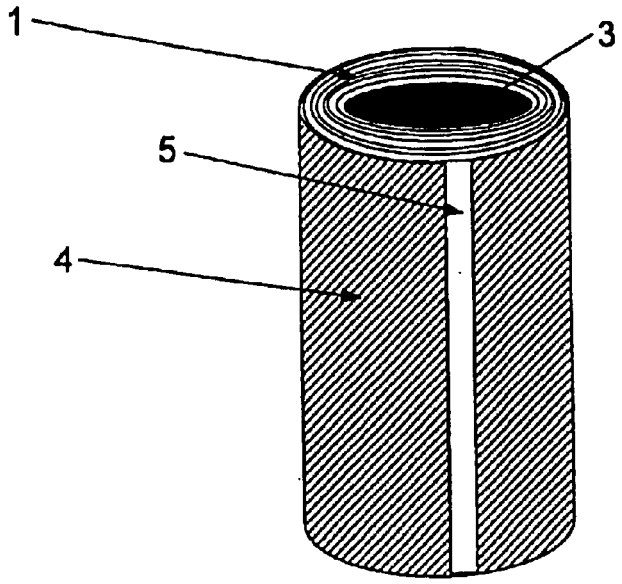
FIG. 2 is a perspective view of the regenerator used in the first embodiment of the invention.

Then, the thin-walled cylindrical sheath 4, the resin film 2, and the cylindrical bobbin 3 are removed, in the form of an integral unit, from the support stand 25, and then the extra portion of the cylindrical bobbin 3 is cut off to obtain a regenerator 1 as shown in FIG. 2. By press-fitting this regenerator I on the inner surface of the enclosure 6 shown in FIG. 7, it is possible to obtain a free-piston-type Stirling cycle refrigerator in which the working gas flows between different layers of the resin film 2.

In this structure, the resin film 2 is wound around the cylindrical bobbin 3 until it reaches the inner surface of the thin-walled cylindrical sheath 4. Therefore, no gap is left between the resin film 2 and the thin-walled cylindrical sheath 4 nor between the resin film 2 and the cylindrical bobbin 3, and thus the working gas does not leak. This helps improve the heat exchange efficiency in the regenerator 1. Moreover, the regenerator 1 is press-fitted on the inner surface of the enclosure 6 shown in FIG. 7. This minimizes the gap between the thin-walled cylindrical sheath 4 and the enclosure 6, and thus helps prevent the leakage of the working gas out of the regenerator 1.

Figure 6:
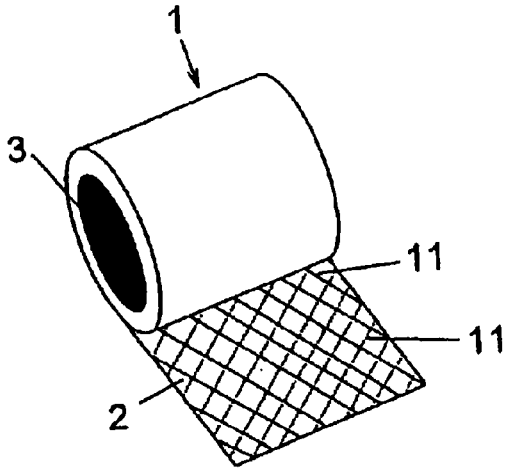
FIG. 6 is a perspective view of a conventional regenerator.

The resin film 2 may be shaped just as the conventional one shown in FIG. 6. The resin film 2 is formed, preferably, of a material with a high specific heat, low thermal conductivity, high heat resistance, and low hygroscopicity, such as polyethylene terephthalate (PET) or polyimide.

There is no particular restriction on how the resin film 2 is fixed to the cylindrical bobbin 3 and to the thin-walled cylindrical sheath 4. For example, they are bonded together with adhesive, or are fused together. Alternatively, it is also possible to produce a regenerator (not shown) based on a solid cylindrical bobbin instead of a hollow cylindrical bobbin 3 and fit it on the outer surface of the enclosure 6.

Second Embodiment

When a free-piston-type Stirling cycle engine is operating, compressed, warm working gas and expanded, cooled working gas flows in reciprocating movement through the regenerator 1. Meanwhile, heat is exchanged between the resin film 2 and the working gas. Here, the heat of the working gas flowing near the inner surface of the thin-walled cylindrical sheath 4 dissipates by conducting through the thin-walled cylindrical sheath 4 to the enclosure 6. This causes a loss of heat in the enclosure 6, and thus lowers the performance of the refrigerator.

To avoid this, in a second embodiment of the invention, as compared with the first embodiment, the thin-walled cylindrical sheath 4 is formed of a highly heat insulating material. Examples of the highly heat insulating material include resins, such as polycarbonate, and ceramics.

In this structure, the heat of the working gas flowing through the regenerator 1 is shielded by the thin-walled cylindrical sheath 4 so as not to conduct to the enclosure 6. This improves the heat storage ability of the regenerator 1, and thus helps improve the heat exchange efficiency.

Third Embodiment

Figure 3:
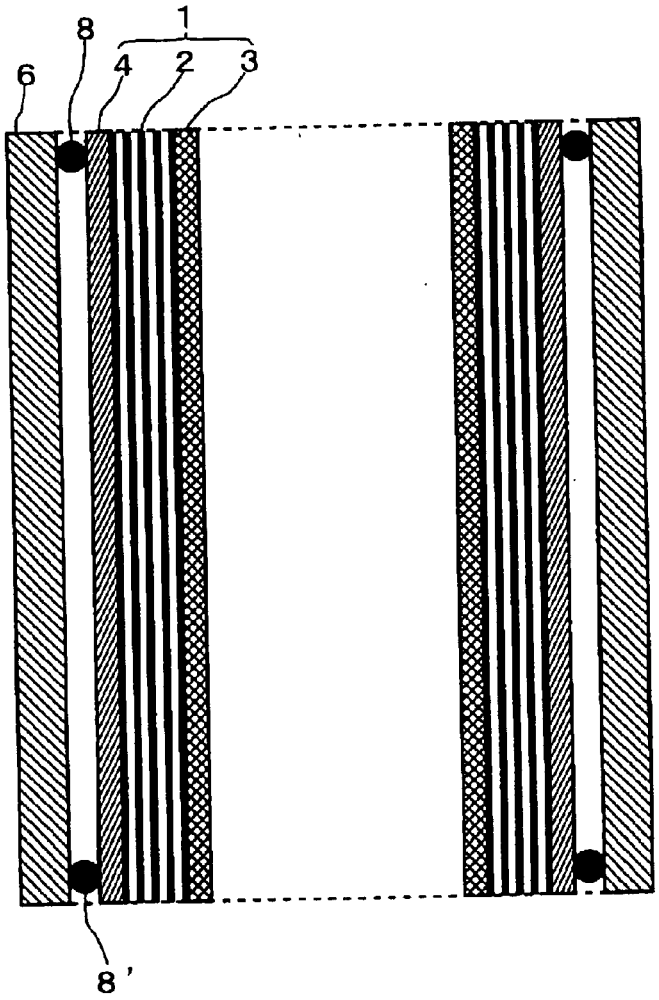
FIG. 3 is a side sectional view of the regenerator used in a third embodiment of the invention and a portion around it.

FIG. 3 is a side sectional view of the regenerator 1 used in a third embodiment of the invention and a portion around it. In the third embodiment, as compared with the first embodiment, around the outer surface of the regenerator 1, i.e. around the outer surface of the thin-walled cylindrical sheath 4, O rings 8 and 8' are fitted so as to seal the space between the thin-walled cylindrical sheath 4 and the enclosure 6.

In this structure, the working gas is prevented from leaking between the outer surface of the thin-walled cylindrical sheath 4 and the inner surface of the enclosure 6. Moreover, by fitting the O rings 8 and 8' at both ends of the regenerator 1, a layer of air is formed between the thin-walled cylindrical sheath 4 and the enclosure 6. This layer of air shields the heat of the working gas so that it does not dissipate by conducting through the thin-walled cylindrical sheath 4 to the enclosure 6. This improves the heat storage ability of the regenerator 1, and thus helps improve the heat exchange efficiency.

One or more additional O rings may be fitted between the O rings 8 and 8'. This not only helps enhance the effect of preventing the leakage of the working gas, but also helps spread the load on the individual O rings.

Fourth Embodiment

Figure 4:
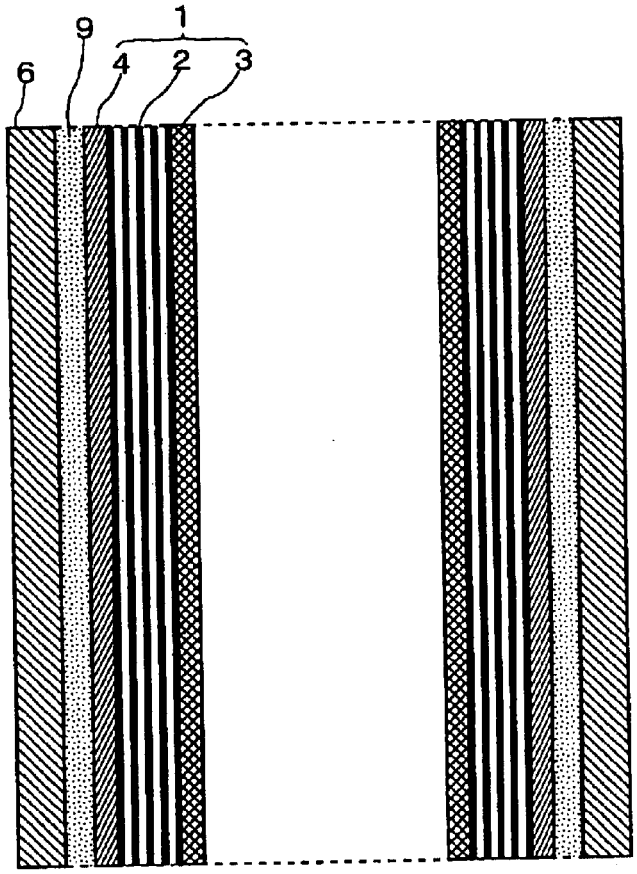
FIG. 4 is a side sectional view of the regenerator used in a fourth embodiment of the invention and a portion around it.

FIG. 4 is a side sectional view of the regenerator 1 used in a fourth embodiment of the invention and a portion around it. In the fourth embodiment, as compared with the first embodiment, the space between the regenerator 1 and the enclosure 6, i.e. the space between the thin-walled cylindrical sheath 4 and the enclosure 6, is filled with adhesive 9 so that no gap is left between the regenerator 1 and the enclosure 6.

In this structure, the working gas is prevented from leaking between the outer surface of the thin-walled cylindrical sheath 4 and the inner surface of the enclosure 6. Moreover, a layer of adhesive 9 is formed between the thin-walled cylindrical sheath 4 and the enclosure 6. This layer of adhesive 9 shields the heat of the working gas so that it does not dissipate by conducting through the thin-walled cylindrical sheath 4 to the enclosure 6. This improves the heat storage ability of the regenerator 1, and thus helps improve the heat exchange efficiency.

The adhesive 9 may be applied over the whole outer surface of the thin-walled cylindrical sheath 4 as shown in FIG. 4, or may be applied so as to make a complete turn around the outer surface of the thin-walled cylindrical sheath 4 in a plurality of positions along it, as do the O rings in the third embodiment. This permits the heat of the working gas to be shielded by the layers of adhesive and of air.

Fifth Embodiment

Figure 5:
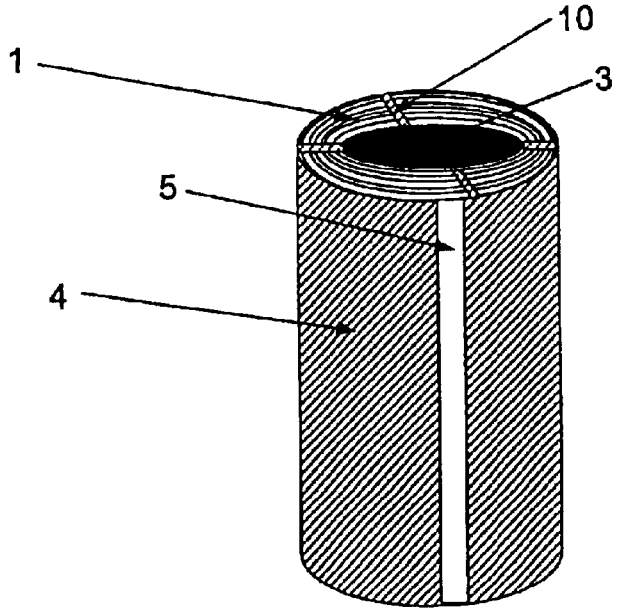
FIG. 5 is a perspective view of the regenerator used in a fifth embodiment of the invention.

FIG. 5 is a perspective view of the regenerator 1 used in a fifth embodiment of the invention. In the fifth embodiment, as compared with the first embodiment, the thin-walled cylindrical sheath 4 has protruding claw portions 10 formed at one end or both ends thereof (in FIG. 5, in four positions), and the claw portions 10 are folded back onto the resin film 2 so that the resin film 2 is fixed so as not to move vertically.

In this structure, when the free-piston-type Stirling cycle engine 14 is operating, the resin film 2 is prevented from being moved vertically by the working gas flowing between different layers thereof. This helps reduce ineffective work by the working gas and thereby improve the heat exchange efficiency, thus improving the performance of the refrigerator.

There is no particular restriction on the number and shape of the claw portions 10 as long as they have an area sufficient to fix the resin film 2 to prevent its vertical movement but not so large as to hinder the flow of the working gas.

Industrial Applicability

Stirling cycle engines according to the present invention can be used as Stirling cycle refrigerators for use in refrigerators, show cases, vending machines, and the like.

What is claimed is:

1. A Stirling cycle engine comprising a regenerator arranged between a compression space and an expansion space so as to serve as a flow passage for working gas reciprocated between the compression and expansion spaces and operate by collecting heat from or releasing heat to the working gas, wherein the regenerator comprises a bobbin, a resin film wound around an outer surface of the bobbin so as to be kept in intimate contact therewith, and a sheath fitted around an outer surface of the resin film and having a slit formed in a longitudinal direction, one end of the resin film being firmly fitted to the outer surface of the bobbin, the outer surface of the resin film being kept in intimate contact with the sheath, and the working gas flowing between different layers of the resin film.

2. A Stirling cycle engine comprising a regenerator arranged between a compression space and an expansion space so as to serve as a flow passage for working gas reciprocated between the compression and expansion spaces and operate by collecting heat from or releasing heat to the working gas, wherein the regenerator comprises a bobbin, a resin film wound around an outer surface of the bobbin, and a sheath fitted around an outer surface of the resin film and having a slit formed vertically therein, the resin film having one end fixed on the outer surface of the bobbin and having another end led out through the slit and fixed to an end surface of the slit or to an outer surface of the sheath, the working gas flowing between different layers of the resin film.

3. A Stirling cycle engine comprising a regenerator arranged inside an enclosure provided between a compression space and an expansion space so as to serve as a flow passage for working gas reciprocated between the compression and expansion spaces and operate by collecting heat from or releasing heat to the working gas, wherein the regenerator comprises a bobbin, a resin film wound around an outer surface of the bobbin, and a sheath fitted around an outer surface of the resin film and having a slit formed vertically therein, the resin film having one end fixed on the outer surface of the bobbin and having another end led out through the slit and fixed to an end surface of the slit or to an outer surface of the sheath, the sheath being press-fitted on an inner surface of the enclosure, the working gas flowing between different layers of the resin film.

4. A Stirling cycle engine as claimed in claim 3, wherein two or more O rings are fitted on the outer surface of the sheath so that no gap is left between the sheath and the enclosure.

5. A Stirling cycle engine as claimed in claim 3, wherein a space between the sheath and the enclosure is filled with adhesive so that no gap is left between the sheath and the enclosure.

6. A Stirling cycle engine as claimed in claim 1, wherein the sheath has claw portions formed at one end or both ends thereof, and the claw portions are folded back onto the resin film so that the resin film is fixed thereby.

7. A Stirling cycle as claimed in claim 1, wherein the sheath is formed of a highly heat insulating material.

8. A Stirling cycle engine as claimed in claim 2, wherein the sheath has claw portions formed at one end or both ends thereof, and the claw portions are folded back onto the resin film so that the resin film is fixed thereby.

9. A Stirling cycle engine as claimed in claim 3, wherein the sheath has claw portions formed at one end or both ends thereof, and the claw portions are folded back onto the resin film so that the resin film is fixed thereby.

10. A Stirling cycle as claimed in claim 2, wherein the sheath is formed of a highly heat insulating material.

11. A Stirling cycle as claimed in claim 3, wherein the sheath is formed of a highly heat insulating material.

* * * * *